US009298153B2

(12) United States Patent
Nakamura et al.

(10) Patent No.: US 9,298,153 B2
(45) Date of Patent: Mar. 29, 2016

(54) DECURLING DEVICE AND IMAGE FORMING APPARATUS

(71) Applicant: FUJI XEROX CO., LTD., Tokyo (JP)

(72) Inventors: Satoshi Nakamura, Kanagawa (JP); Yasuto Okabayashi, Kanagawa (JP); Masakatsu Eda, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/617,324

(22) Filed: Feb. 9, 2015

(65) Prior Publication Data

US 2015/0268612 A1 Sep. 24, 2015

(30) Foreign Application Priority Data

Mar. 24, 2014 (JP) ..... 2014-060659

(51) Int. Cl.
*G03G 15/00* (2006.01)
*B65H 3/66* (2006.01)
*B65H 5/36* (2006.01)

(52) U.S. Cl.
CPC ..... *G03G 15/6576* (2013.01)

(58) Field of Classification Search
CPC ..... G03G 15/6576; G03G 15/235; G03G 2215/00662; G03G 2215/00421; G03G 2215/00426; B65H 2301/512565; B65H 2301/51256; B65H 23/34; B65H 23/0258; B65H 23/025
See application file for complete search history.

(56) References Cited

U.S. PATENT DOCUMENTS 7,574,158 B2 * 8/2009 Uehara ..... G03G 15/234 399/122

FOREIGN PATENT DOCUMENTS

JP 2008096690 A * 4/2008 ..... G03G 15/20
JP 2009249167 A * 10/2009 ..... B65H 29/70

* cited by examiner

*Primary Examiner* — Daniel J Colilla
*Assistant Examiner* — Ruben Parco, Jr.
(74) *Attorney, Agent, or Firm* — Oliff PLC

(57) ABSTRACT

A decurling device includes a shaft; a decurling roller that has a diameter larger than that of the shaft, that becomes concave along an outer periphery of the shaft by being pressed against the shaft, and that removes curl from a transported object by nipping the transported object between the decurling roller and the shaft; and a restriction unit that restricts a direction in which the shaft is bent due to a load that the shaft receives from the decurling roller so that a middle portion of the shaft in an axial direction is convexly curved downstream in a transport direction of the transported object.

6 Claims, 12 Drawing Sheets

FIG. 10

SHEET-CREASE EVALUATION RESULT

| | CURVATURE OF DECURLING SHAFT DOWNSTREAM IN TRANSPORT DIRECTION | CREASE EVALUATION RESULT | |
|---|---|---|---|
| | | SIMPLEX PRINTING | DUPLEX PRINTING |
| COMPARATIVE EXAMPLE (FIG. 7) | SMALL | POOR | POOR |
| PRESENT EXEMPLARY EMBODIMENT (FIG. 4) | INTERMEDIATE | GOOD | FAIR |
| MODIFICATION (FIG. 9) | LARGE | GOOD | GOOD |

POOR: CREASE OCCURRED IN LOW-BASIS-WEIGHT PLAIN PAPER AND COATED PAPER

FAIR: CREASE DID NOT OCCUR IN LOW-BASIS-WEIGHT PLAIN PAPER BUT CREASE OCCURRED IN COATED PAPER

GOOD: CREASE DID NOT OCCUR IN LOW-BASIS-WEIGHT PLAIN PAPER NOR COATED PAPER

DECURLING DEVICE AND IMAGE FORMING APPARATUS

CROSS-REFERENCE TO RELATED APPLICATIONS

This application is based on and claims priority under 35 USC 119 from Japanese Patent Application No. 2014-060659 filed Mar. 24, 2014.

BACKGROUND

1. Technical Field

The present invention relates to a decurling device and an image forming apparatus.

2. Summary

According to an aspect of the present invention, a decurling device includes a shaft; a decurling roller that has a diameter larger than that of the shaft, that becomes concave along an outer periphery of the shaft by being pressed against the shaft, and that removes curl from a transported object by nipping the transported object between the decurling roller and the shaft; and a restriction unit that restricts a direction in which the shaft is bent due to a load that the shaft receives from the decurling roller so that a middle portion of the shaft in an axial direction is convexly curved downstream in a transport direction of the transported object.

BRIEF DESCRIPTION OF THE DRAWINGS

An exemplary embodiment of the present invention will be described in detail based on the following figures, wherein:

FIG. 10 is a table showing evaluation results.

DETAILED DESCRIPTION

Hereinafter, an exemplary embodiment of the present invention will be described with reference to the drawings.

Structure of Image Forming Apparatus 10

Figure 1:
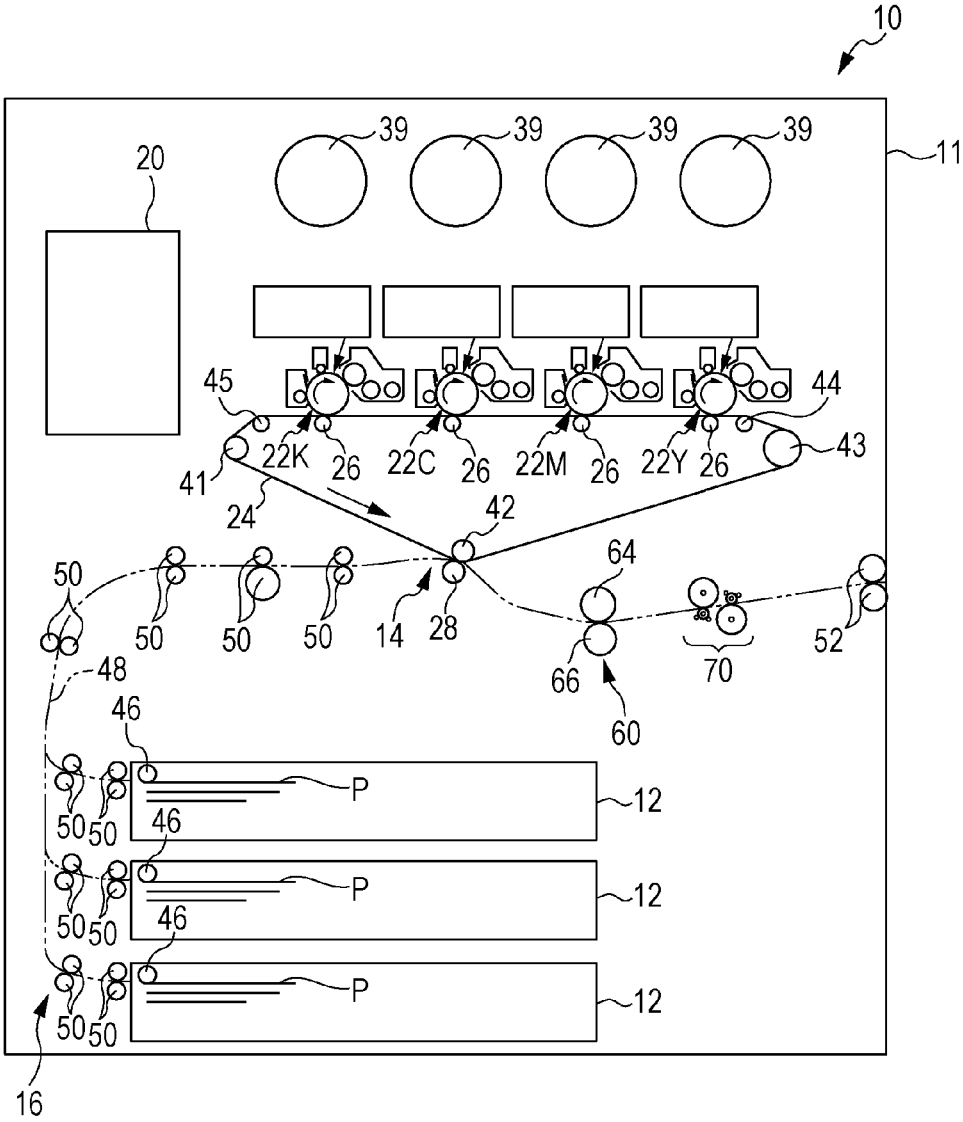
FIG. 1 is a schematic view illustrating the structure of an image forming apparatus according to the present exemplary embodiment.

First, the structure of an image forming apparatus 10 according to the present exemplary embodiment will the described. FIG. 1 is a schematic view illustrating the structure of the image forming apparatus 10.

As illustrated in FIG. 1, the image forming apparatus 10 includes an image forming apparatus body 11 (housing), in which trays 12, an image forming section 14, a transport unit 16, a controller 20, and other components of the image forming apparatus 10 are disposed. Each of the trays 12 holds a recording medium P (an example of a transported object). The image forming section 14 forms an image on the recording medium P. The transport unit 16 transports the recording medium P from the tray 12 to the image forming section 14. The controller 20 controls operations of various parts of the image forming apparatus 10. The recording medium P is, for example, a sheet of paper.

The image forming section 14 includes image forming units 22Y, 22M, 22C, and 22K (hereinafter, referred to as the image forming units 22Y to 22K); an intermediate transfer belt 24; first-transfer rollers 26; and a second-transfer roller 28. The image forming units 22Y to 22K respectively form yellow (Y), magenta (M), cyan (C), and black (K) toner images. The toner images formed by the image forming units 22Y to 22K are transferred to the intermediate transfer belt 24. The first-transfer rollers 26 transfer the toner images formed by the image forming units 22Y to 22K to the intermediate transfer belt 24. The second-transfer roller 28 transfers the toner images, which have been transferred to the intermediate transfer belt 24, from the intermediate transfer belt 24 to the recording medium P. The structure of the image forming section 14 is not limited to the structure described above. The image forming section 14 may have a different structure, as long as the image forming section 14 forms an image on the recording medium P.

Figure 2:
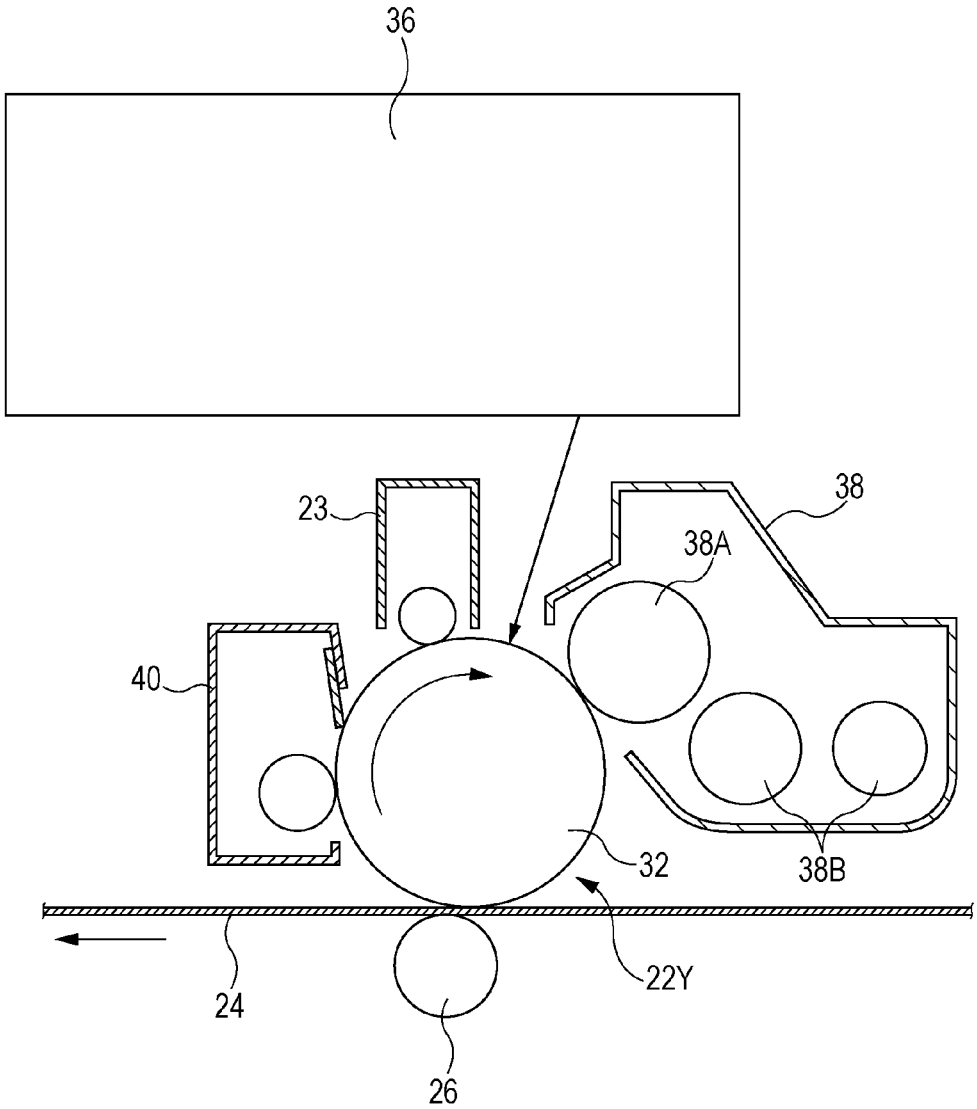
FIG. 2 is a schematic view illustrating the structure of an image forming unit according to the present exemplary embodiment.

The image forming units 22Y to 22K are disposed above the intermediate transfer belt 24 so as to be arranged in the horizontal direction. As illustrated in FIG. 2, each of the image forming units 22Y to 22K includes a photoconductor 32 that rotates in one direction (for example, clockwise in FIG. 2). FIG. 2 illustrates the structure of only the image forming unit 22Y, because the image forming units 22Y to 22K have the same structure.

Around each of the photoconductors 32, a charging device 23, an exposure device 36, a developing device 38, and a removal device 40 are arranged in this order in the direction in which the photoconductor 32 rotates. The charging device 23 charges the photoconductor 32. The exposure device 36 forms an electrostatic latent image by exposing the photoconductor 32, which has been charged by the charging device 23, to light. The developing device 38 forms a toner image by developing the electrostatic latent image. The removal device 40 removes remaining toner on the photoconductor 32 by contacting the photoconductor 32.

The exposure device 36 forms an electrostatic latent image on the basis of an image signal sent from the controller 20 (see FIG. 1). Examples of an image signal sent from the controller 20 include an image signal that the controller 20 has received from an external apparatus.

The developing device 38 includes a developer supplying member 38A and transport members 38B. The developer supplying member 38A supplies a developer to the photoconductor 32. The transport members 38B transport the developer, to be supplied to the developer supplying member 38A, while agitating the developer.

As illustrated in FIG. 1, toner containers 39 are disposed above the exposure devices 36. Each of the toner containers 39 holds a toner to be supplied to the developing device 38 of a corresponding one of the image forming units 22Y to 22K.

The intermediate transfer belt 24, which has a looped shape, is disposed below the image forming units 22Y to 22K. Support rollers 41, 42, 43, 44, and 45, over which the intermediate transfer belt 24 is looped, are disposed on the inner periphery of the intermediate transfer belt 24. For example, the intermediate transfer belt 24 is rotated by, for example, the support roller 43 in one direction (for example, the counter-clockwise direction in FIG. 1) while being in contact with the photoconductors 32. The support roller 42 is a counter roller, which faces the second-transfer roller 28.

Each of the first-transfer rollers 26 faces a corresponding one of the photoconductors 32 with the intermediate transfer belt 24 therebetween. A position between the first-transfer roller 26 and the photoconductor 32 is a first-transfer position, at which a toner image formed on the photoconductor 32 is transferred to the intermediate transfer belt 24.

The second-transfer roller 28 faces the support roller 42 with the intermediate transfer belt 24 therebetween. A position between the second-transfer roller 28 and the support roller 42 is a second-transfer position, at which a toner image, which has been transferred to the intermediate transfer belt 24, is transferred to the recording medium P.

The transport unit 16 includes feed rollers 46, a transport path 48, and transport rollers 50. Each of the feed rollers 46 feeds a recording medium P from a corresponding one of the trays 12. The recording medium P fed by the feed roller 46 is transported along the transport path 48. The transport rollers 50 transport the recording medium P, which has been fed by the feed roller 46 along the transport path 48, to the second-transfer position.

A fixing unit 60 is disposed downstream from the second-transfer position in the transport direction. The fixing unit 60 fixes the toner image, which has been transferred to the recording medium P by the second-transfer roller 28, to the recording medium P. The fixing unit 60 includes a heating member 64, such as a heating roller, and a pressing member 66, such as a pressing roller. In the fixing unit 60, the heating member 64 applies heat and the pressing member 66 applies pressure to the recording medium P to fix the toner image to the recording medium P, while nipping the recording medium P between the heating member 64 and the pressing member 66 and transporting the recording medium P.

As illustrated in FIG. 1, a decurling device 70 is disposed downstream from the fixing unit 60 in the transport direction. The decurling device 70 removes curl from the recording medium P to which a toner image has been fixed. The structure of the decurling device 70 will be described below.

Transport rollers 52 are disposed downstream from the decurling device 70 in the transport direction. The transport rollers 52 transport the recording medium P, from which curl has been removed, to an output unit (not shown).

Image Forming Operation

Next, an image forming operation, which is performed by the image forming apparatus 10 according to the present exemplary embodiment to form an image on a recording medium P, will be described.

When the image forming apparatus 10 starts the image forming operation, one of the feed rollers 46 feeds a recording medium P from a corresponding one of the trays 12, and the transport rollers 50 feed the recording medium P to the second-transfer position.

In the image forming units 22Y to 22K, the charging devices 23 charge the photoconductors 32, and the exposure device 36 exposes the photoconductors 32 with light, thereby forming electrostatic latent images on the photoconductors 32. The developing devices 38 develop the electrostatic latent images to form color toner images on the photoconductors 32. The color toner images, which have been formed by the image forming units 22Y to 22K, are transferred to the intermediate transfer belt 24 at the first-transfer positions so as to overlap each other, thereby forming a color image. The color image, which has been formed on the intermediate transfer belt 24, is transferred to the recording medium P at the second-transfer position.

The recording medium P, to which the toner image has been transferred, is transported to the fixing unit 60, and the fixing unit 60 fixes the toner image to the recording medium P. The decurling device 70 removes curl from the recording medium P, to which the toner image has been fixed. The transport rollers 52 transport the recording medium P, from which curl has been removed, toward the output unit (not shown). When the image forming operation has been performed through the steps described above, an image is formed on one side of the recording medium P.

The image forming apparatus 10 further includes a reverse transport path (not shown) for transporting the recording medium P, from which curl has been removed, back to the second-transfer position before the recording medium P is output to the output unit (not shown). When forming images on both sides of a recording medium P, the recording medium P, on one side of which an image has been formed, is transported along the reverse transport pat back to the second-transfer position, where an image is formed on the other side of the recording medium P.

Structure of Decurling Device 70

Figure 3:
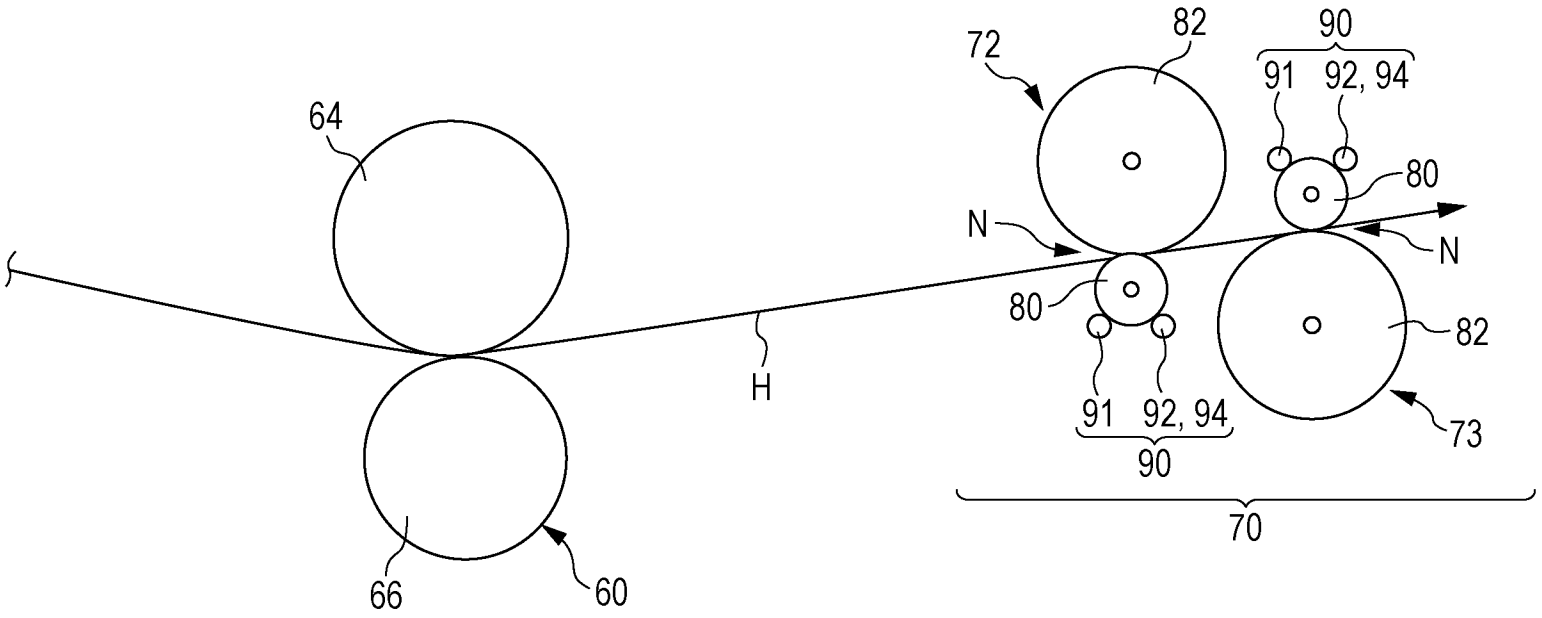
FIG. 3 is a side view illustrating the structure of a decurling device according to the present exemplary embodiment.

Next, the structure of the decurling device 70 will be described. FIG. 3 is a side view illustrating the structure of the decurling device 70.

As illustrated in FIG. 3, the decurling device 70 includes an upward decurling unit 72 and a downward decurling unit 73. The upward decurling unit 72 removes upward curl (downwardly convex curl) from a recording medium P. The downward decurling unit 73 removes downward curl (upwardly convex curl) from the recording medium P.

The upward decurling unit 72 and the downward decurling unit 73 have the same structure, except that they are disposed in vertically opposite orientations. Therefore, only the upward decurling unit 72 will be described below and description of the downward decurling unit 73 will be omitted. The decurling device 70 may include at least one of the upward decurling unit 72 and the downward decurling unit 73.

The upward decurling unit 72 includes a decurling shaft 80 (an example of a shaft) and a decurling roller 82 (an example of a decurling roller) having a diameter larger than that of the decurling shaft 80.

The decurling shaft 80 includes a metal shaft. The decurling shaft 80 is disposed below the decurling roller 82. The decurling shaft 80 is rotated by a droving force generated by a driving unit (not shown).

The decurling roller 82 includes a roller made of an elastic material. The decurling roller 82 becomes concave along the outer periphery of the decurling shaft 80 at a nip portion N (contact portion), which is formed when the decurling roller 82 is pressed against the decurling shaft 80.

The decurling roller 82 and the decurling shaft 80 nip the recording medium P (an example of a transported object) therebetween to press the recording medium P. In this state, the decurling roller 82 is rotated by the decurling shaft 80 and transports the recording medium P. Thus, the decurling roller 82 and the decurling shaft 80 remove curl from the recording medium P by transporting the recording medium P while pressing the recording medium P.

The upward decurling unit 72 includes a restriction unit 90 that restricts a direction in which the decurling shaft 80 is bent due to a load that the decurling shaft 80 receives from the decurling roller 82 so that a middle portion of the decurling shaft 80 in the axial direction is convexly curved downstream in the transport direction. In each of FIGS. 3, 4, and 8, the transport direction of the recording medium P is indicted by an arrow H.

Figure 4:
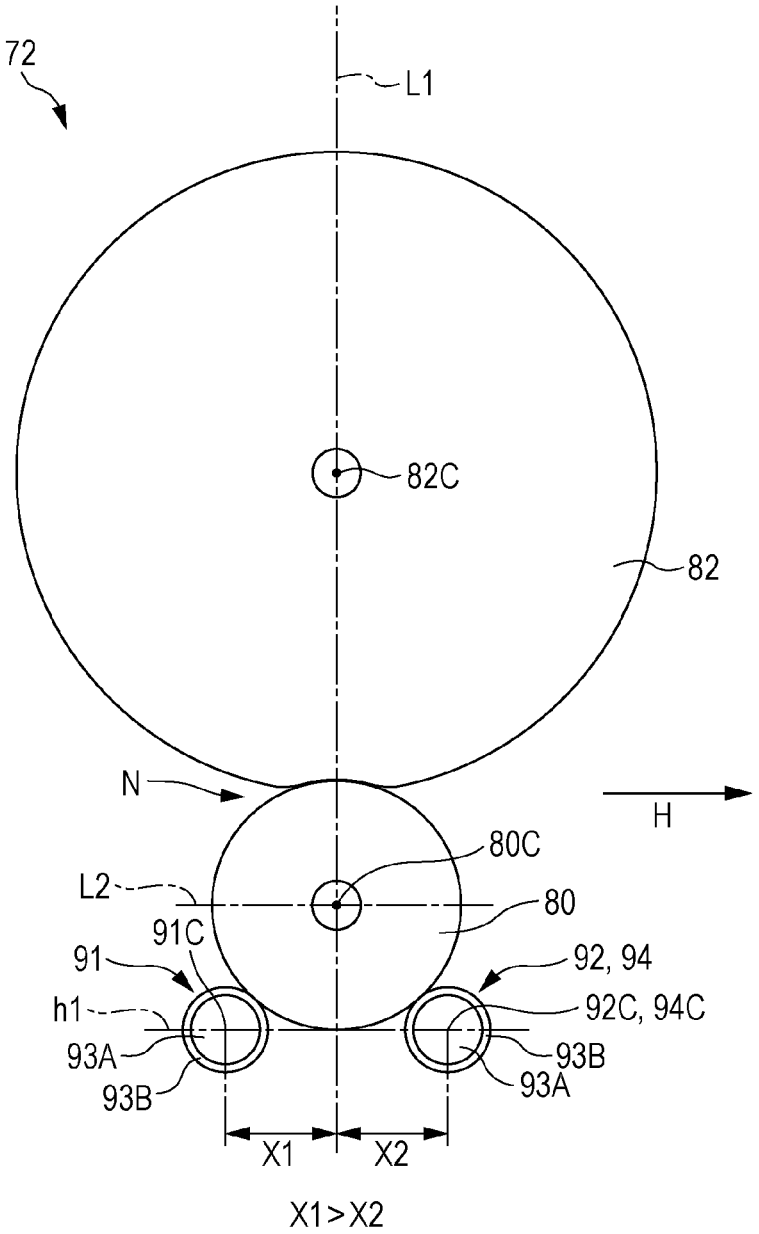
FIG. 4 is a side view illustrating the structure of an upward decurling unit according to the present exemplary embodiment.
Figure 5:
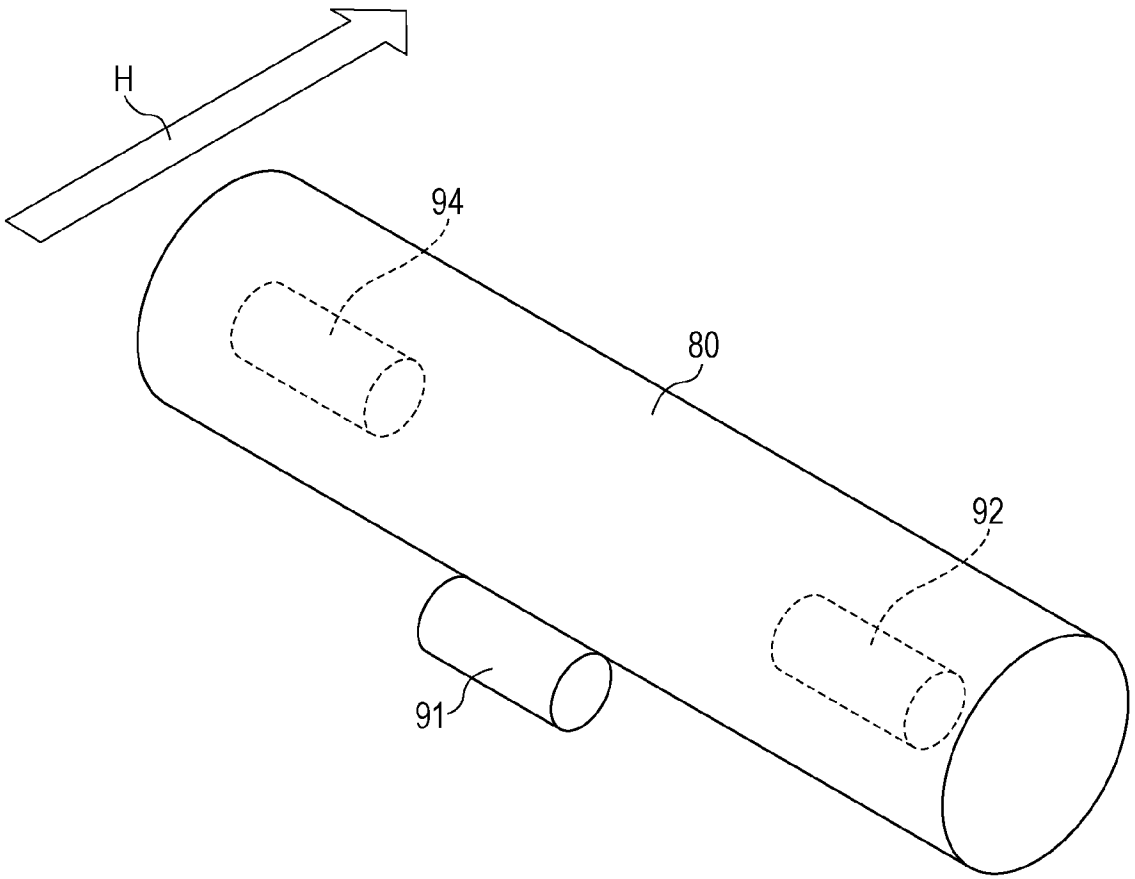
FIG. 5 is a perspective view illustrating a part of the structure of the upward decurling unit according to the present exemplary embodiment.

As illustrated in FIGS. 4 and 5, the restriction unit 90 includes downstream rollers 92 and 94 (which are examples of first contact members and first contact rollers) and an upstream roller 91 (which is an example of a second contact member and a second contact roller). The downstream rollers 92 and 94 are disposed downstream from the decurling shaft 80 in the transport direction downstream. The upstream roller 91 is disposed upstream from the decurling shaft 80 in the transport direction.

The downstream roller 92 and the downstream roller 94 have the same structure. As illustrated in FIG. 4, the downstream rollers 92 and 94 each have an elastic layer 93B, which is made of rubber or the like, in an outer peripheral portion thereof. To be specific, each of the downstream rollers 92 and 94 includes the elastic layer 93B and a shaft 93A, around which the elastic layer 93B is disposed. The shaft 93A is made of a material (a resin, a metal, or the like) that has a rigidity higher than that of the elastic layer 93B.

As illustrated in FIG. 5, the downstream rollers 92 and 94 are respectively disposed at positions that are downstream from the decurling shaft 80 and that are near one end and the other end of the decurling shaft 80 in the axial direction. To be specific, as illustrated in FIG. 4, the downstream rollers 92 and 94 are in contact with the decurling shaft 80 at positions that are downstream in the transport direction from a straight line L1 that connects an axis 80C of the decurling shaft 80 and a roller axis 82C of the decurling roller 82 to each other.

The downstream rollers 92 and 94 are disposed below the decurling shaft 80. In other words, the downstream rollers 92 and 94 are disposed on the opposite side of the decurling shaft 80 from the decurling roller 82. The downstream rollers 92 and 94 may be in contact with the decurling shaft 80 at any appropriate positions below a straight line L2 that passes through the axis 80C of the decurling shaft 80 and that is perpendicular to the straight line L1.

The downstream rollers 92 and 94, which are in contact with the decurling shaft 80 as described above, restrict deformation of both end portions, in the axial direction, of the decurling shaft 80 downstream in the transport direction. The downstream rollers 92 and 94 are rotated by the decurling shaft 80.

The upstream roller 91 has a structure similar to those of the downstream rollers 92 and 94. The upstream roller 91 includes the shaft 93A and the elastic layer 93B disposed around of the shaft 93A. The elastic layer 93B of each of the downstream rollers 92 and 94 is thicker than the elastic layer 93B of the upstream roller 91.

As illustrated in FIG. 5, the upstream roller 91 is disposed at a position that is near a middle portion of the decurling shaft 80 in the axial direction and that is upstream from the decurling shaft 80 in the transport direction. To be specific, as illustrated in FIG. 4, the upstream roller 91 is in contact with the decurling shaft 80 at a position upstream from the straight line L1 in the transport direction.

The upstream roller 91 is disposed below the decurling shaft 80. In other words, the downstream rollers 92 and 94 are disposed on the opposite side of the decurling shaft 80 from the decurling roller 82. The upstream roller 91 may be in contact with the decurling shaft 80 at any appropriate position below the straight line L2.

The distance X1 from the straight line L1 to a roller axis 91C of the upstream roller 91 is larger than the distance X2 from the straight line L1 to roller axes 92C and 94C of the downstream rollers 92 and 94.

The height of the roller axis 91C of the upstream roller 91 is the same as the height h1 of each of the roller axes 92C and 94C of the downstream rollers 92 and 94. The diameter of the upstream roller 91 is larger than or equal to that of each of the downstream rollers 92 and 94. The amount by which the upstream roller 91 becomes concave by being pressed against the decurling shaft 80 is smaller than that of each of the downstream rollers 92 and 94.

The upstream roller 91, which is in contact with the decurling shaft 80 as described above, restricts bending of the middle portion, in the axial direction, of the decurling shaft 80 upstream in the transport direction. The upstream roller 91 is rotated by the decurling shaft 80.

With the decurling device 70, for example, depending on whether curl of the recording medium P is upward curl or downward curl, one of the upward decurling unit 72 and the downward decurling unit 73 is selectively used. When one of the decurling units is not used for decurling, for example, the amount by which the decurling roller 82 of the decurling unit becomes convex by being pressed against the decurling shaft 80 is reduced. The decurling unit is used as a transport unit for transporting a recording medium P. The direction of curl of a recording medium P is estimated from, for example, the type of the recording medium P on which an image is formed and the amount of toner transferred to the recording medium P.

Operation of Present Exemplary Embodiment

Next, an operation of the present exemplary embodiment will be described.

With the decurling device 70 according to the present exemplary embodiment, a recording medium P fed to a space between the decurling roller 82 and the decurling shaft 80 is transported while being pressed by the decurling roller 82 and the decurling shaft 80. As a result, curl is removed from the recording medium P.

As illustrated in FIG. 4, in the present exemplary embodiment, the distance X1 is larger than the distance X2. Accordingly, as illustrated in FIG. 6, the distance Y1 from a contact position S1, at which the upstream roller 91 is in contact with the decurling shaft 80, to the straight line L1 is larger than the distance Y2 from contact positions S2, at which the downstream rollers 92 and 94 are in contact with the decurling shaft 80, to the straight line L1.

Figure 6B:
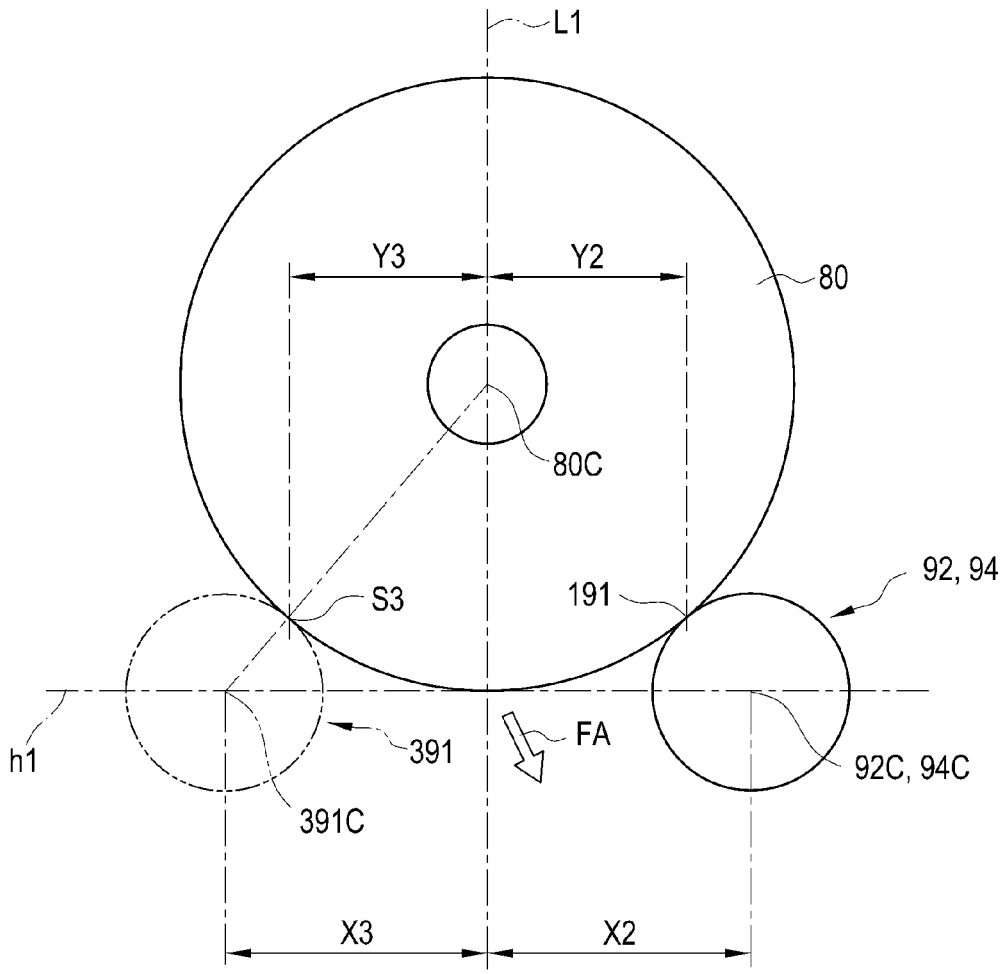
Figure 7:
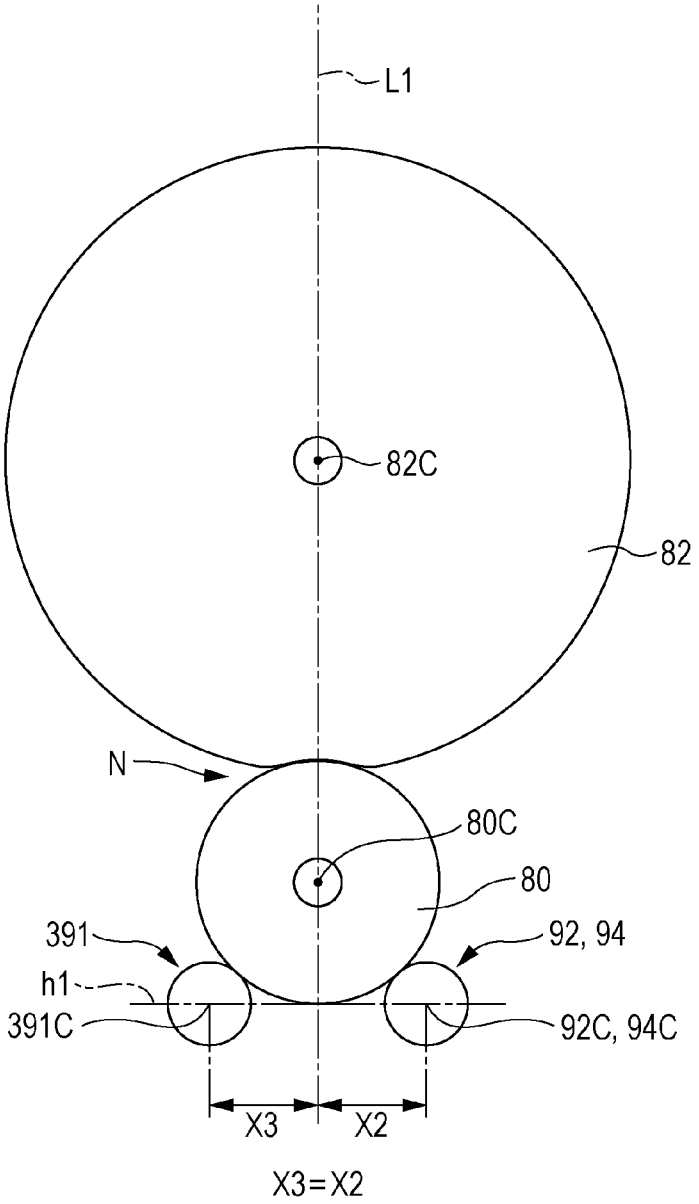
FIG. 7 is a side view illustrating the structure of an upward decurling unit according to a comparative example.

FIG. 7 illustrates the structure of an upper decurling unit according to a comparative example, which includes an upstream roller 391 and in which the distance X3 from the straight line L1 to a roller axis 391C is the same as the distance X2. In this case, as illustrated in FIG. 6B, the distance Y3 from a contact position S3, at which the upstream roller 391 is in contact with the decurling shaft 80, to the straight line L1 is the same as the distance Y2 from the contact positions S2, at which the downstream rollers 92 and 94 are in contact with the decurling shaft 80, to the straight line L1.

In other words, the upstream roller 391 and the downstream rollers 92 and 94 support load from the decurling shaft 80 at positions that are separated from the straight line L1 by the same distance upstream and downstream in the transport direction. Accordingly, there is only a small difference between supporting forces that support the load that the decurling shaft 80 receives from the decurling roller 82 from the upstream side and the downstream side.

In contrast, according to the present exemplary embodiment, as described above, the upstream roller 91 restricts bending the middle portion, in the axial direction, of the decurling shaft 80 upstream in the transport direction. Moreover, the distance Y1 is larger than the distance Y2. Therefore, the direction of a load that the decurling shaft 80 receives from the decurling roller 82 has a component that is directed downstream in the transport direction at a middle portion of the decurling shaft 80 in the axial direction, as indicated by an arrow FA in FIGS. 6A-6C.

Figure 8:
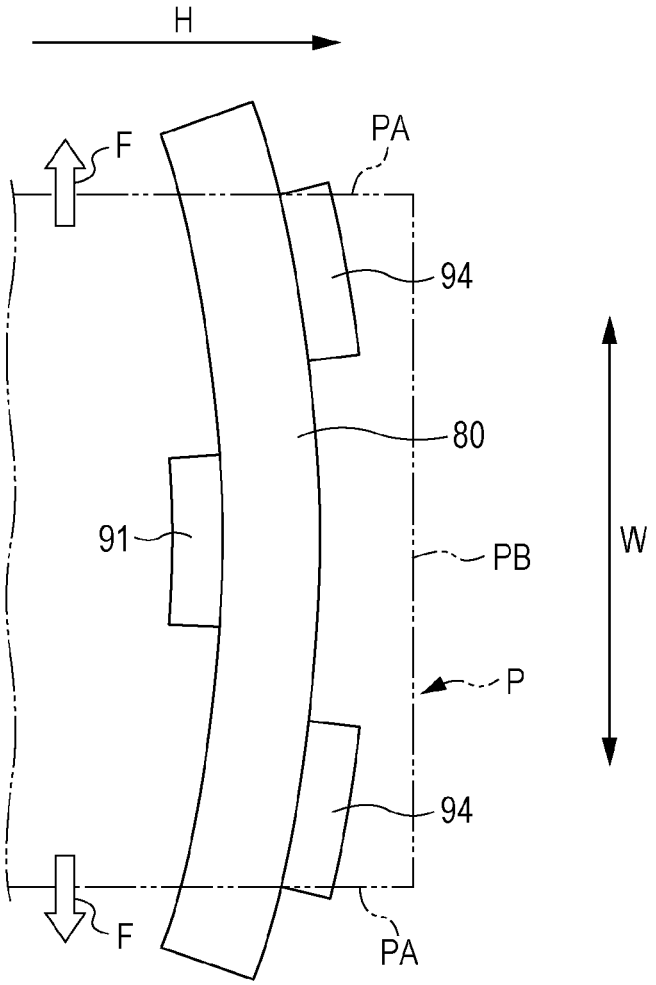
FIG. 8 is a plan view illustrating a state in which a recording medium is being transported by the upward decurling unit according to the present exemplary embodiment.

Thus, as illustrated in FIG. 8, due to a load that the decurling shaft 80 receives from the decurling roller, the middle portion of the decurling shaft 80 in the axial direction becomes convexly curved downstream in the transport direction effectively.

Because the middle portion of the decurling shaft 80 becomes convexly curved downstream in the transport direction, end portions PA (side end portions) of the recording medium P in the width direction are first nipped between the decurling roller 82 and the decurling shaft 80 and then a middle portion PB in the width direction is nipped between the decurling roller 82 and the decurling shaft 80. Thus, a transport force is first applied to the end portions PA of the recording medium P in the width direction and then applied to the middle portion PB of the recording medium P in the width direction. As a result, forces F are applied to the recording medium P so as to stretch the recording medium P in the width direction, and therefore occurrence of a crease is suppressed.

The term "the width direction" of the recording medium P refers to a direction perpendicular to the transport direction, which is indicated by an arrow W in FIG. 8. In FIG. 8, the amount of bending of the decurling shaft 80 is exaggerated.

Figure 6A:
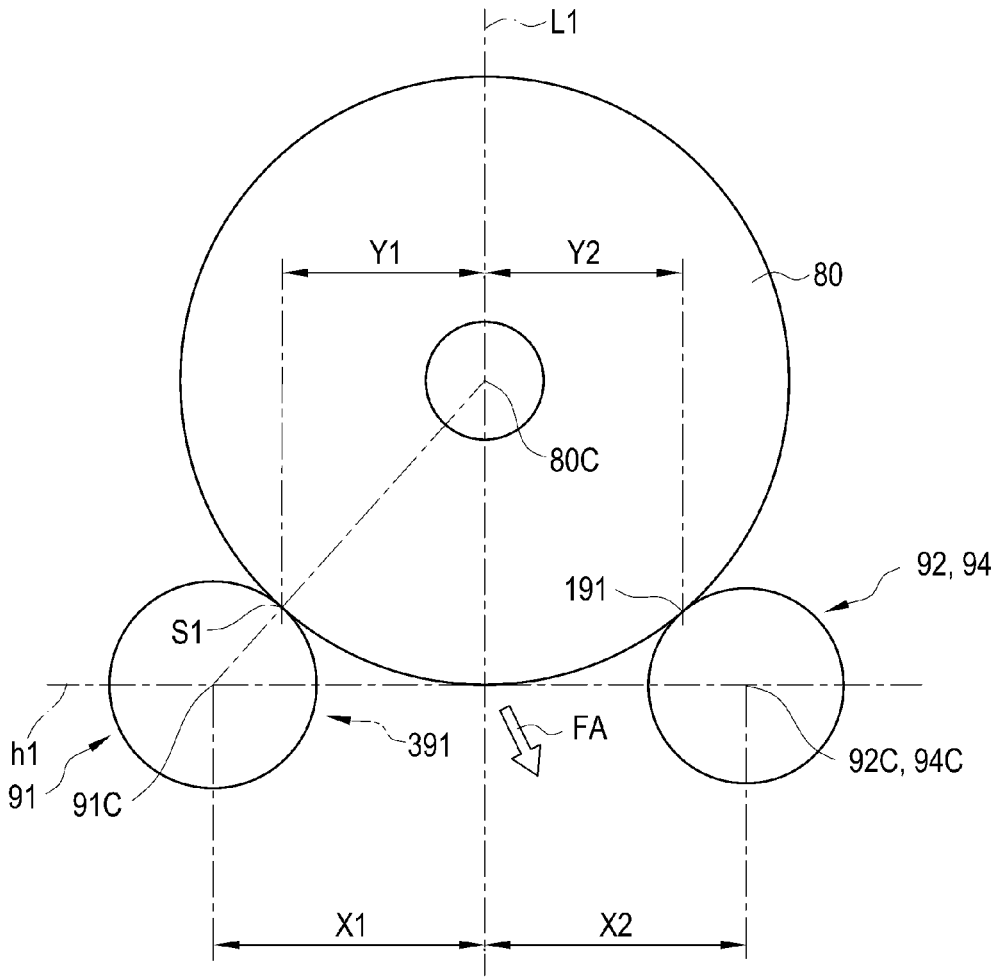
FIGS. 6A-6C are a side view illustrating the positional relationship of an upstream roller relative to a decurling shaft according to the present exemplary embodiment.
Figure 6C:
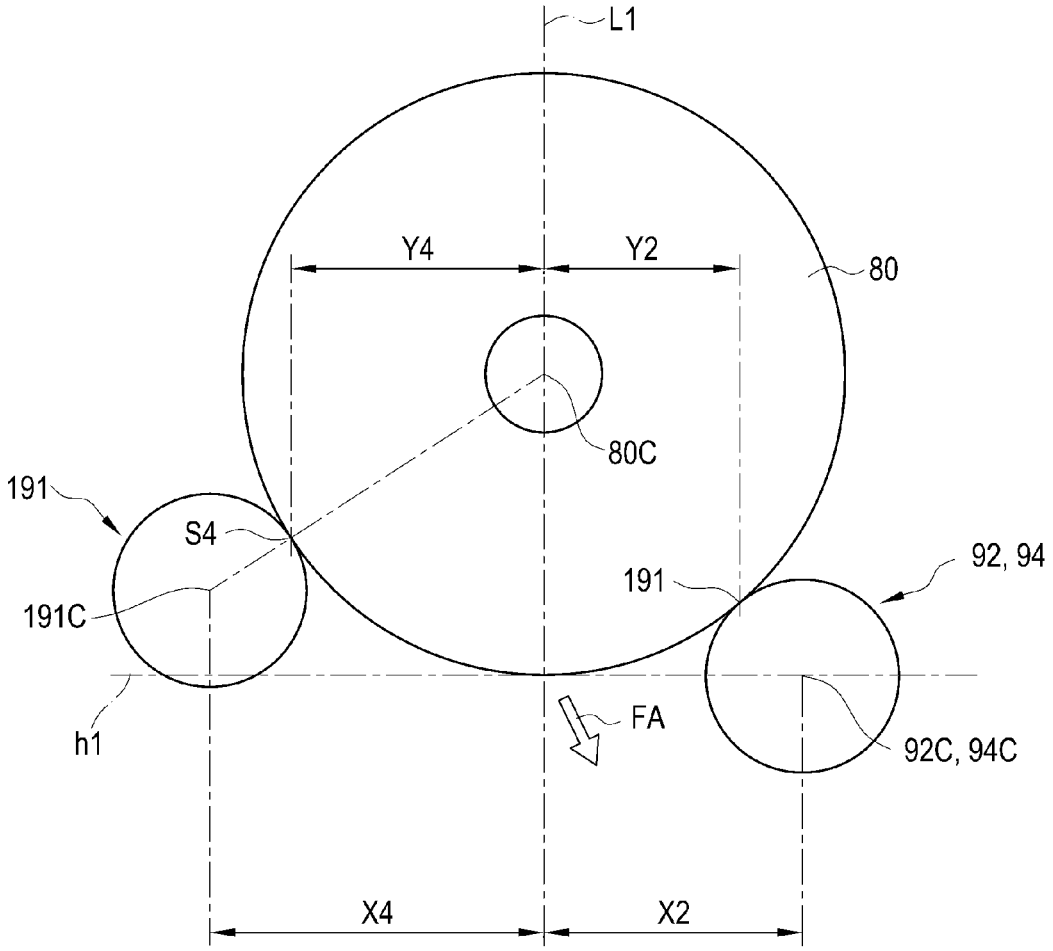

According to the present exemplary embodiment, the direction of a load that the decurling shaft 80 receives from the decurling roller 82 has a component that is directed downstream in the transport direction, as indicated by an arrow FA in FIGS. 6A-6C. Therefore, a load that the downstream rollers 92 and 94 receive from the decurling shaft 80 is larger than a load that the upstream roller 91 receives from the decurling shaft 80. Moreover, according to the present exemplary embodiment, the elastic layer 93B of each of the downstream rollers 92 and 94, to which a relatively large load is applied from the decurling shaft 80, is thicker than the elastic layer 93B of the upstream roller 91. As a result, the elastic layer 93B of each of the downstream rollers 92 and 94 easily becomes convex and contacts the decurling shaft 80 over a wide contact area, and therefore pressures that are locally applied from the decurling shaft 80 to the downstream rollers 92 and 94 are suppressed.

As long as the distance Y1 is larger than the distance Y2, the diameters, the shapes, and the positional relationship of the upstream roller 91 and the downstream rollers 92 and 94, which are examples of contact members, are not limited to those described above.

Modification

Next, a modification will be described.

In the exemplary embodiment described above, the height of the roller axis 91C of the upstream roller 91 is the same as the height h1 of the roller axes 92C and 94C of the downstream rollers 92 and 94. However, this is not a limitation. For example, an upstream roller 191 shown in FIG. 9 may be used. The upstream roller 191 is in contact with the decurling shaft 80 at such a position that the height of a roller axis 191C is larger than the height h1 of the roller axes 92C and 94C of the downstream rollers 92 and 94.

Except for the height (the position in a side view), the upstream roller 191 according to the modification has the same structure as that of the upstream roller 91. The upstream roller 191 has the same diameter as that of each of the downstream rollers 92 and 94.

With this structure, the upstream roller 191 is in contact with the decurling shaft 80 at such a position that the height of the roller axis 191C is larger than the height h1 of the roller axes 92C and 94C of the downstream rollers 92 and 94. Therefore, the distance X4 from the straight line L1 to the roller axis 191C is larger than the distance X2 from the straight line L1 to the roller axes 92C and 94C of the downstream rollers 92 and 94. Moreover, as illustrated in FIG. 6C, the distance X4 is larger than the distance X3.

Thus, as illustrated in FIG. 6C, the distance Y4 from the contact position S4, at which the upstream roller 191 is in contact with the decurling shaft 80, to the straight line L1 is larger than the distance Y2 and the distance Y1. Therefore, the direction of a load that the decurling shaft 80 receives from the decurling roller 82 has a component that is directed downstream in the transport direction, as indicated by the arrow FA in FIG. 6C, at the middle portion of the decurling shaft 80 in the axial direction.

Thus, as illustrated in FIG. 8, due to a load that the decurling shaft 80 receives from the decurling roller 82, the middle portion of the decurling shaft 80 in the axial direction becomes convexly curved downstream in the transport direction efficiently. Therefore, with the structure according to the modification, occurrence of a crease of a recording medium P is more efficiently suppressed than with the structure in which the height of the roller axis of the upstream roller is the same as the height h1 of the roller axes 92C and 94C of the downstream rollers 92 and 94.

Evaluation

Figure 9:
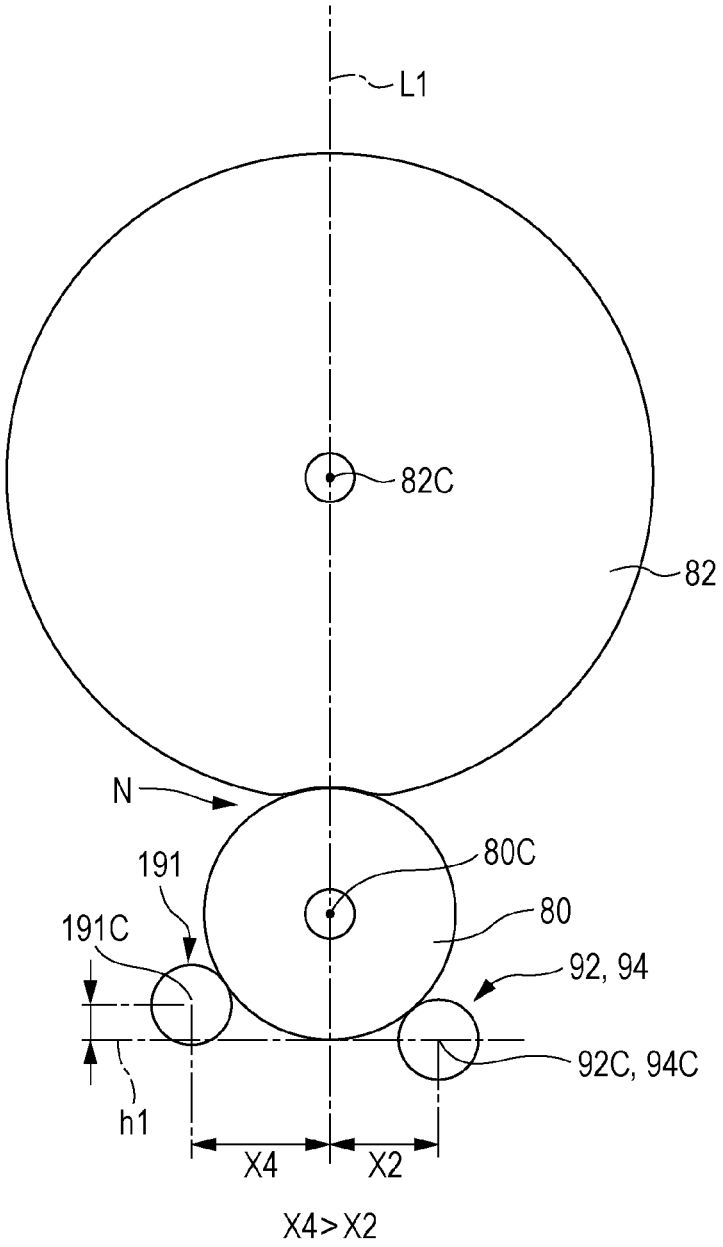
FIG. 9 is a side view illustrating the structure of an upward decurling unit according to a modification.

FIG. 10 shows the results of evaluation, in which occurrence of a crease of a recording medium P was evaluated for the structure according to the comparative example (FIG. 7), the structure according to the present exemplary embodiment (FIG. 4), and the structure according to the modification (FIG. 9). The evaluation was performed as follows: a low-basis-weight plain paper sheet (80 g/m$^2$) and a coated paper sheet were used as a recording medium P; simplex printing (an operation of forming an image on one side of the recording medium P) and duplex printing (an operation of forming images on both sides of the recording medium P) were performed on the recording medium P by using the image forming apparatus 10; and, whether or not a crease occurred was examined in each of these cases.

Ratings were assigned as follows: "poor" if a crease occurred in a low-basis-weight plain paper sheet and in a coated paper sheet; "fair" if a crease occurred in a coated paper sheet but did not occur in a low-basis-weight plain paper sheet; and "good" if a crease did not occur in a low-basis-weight plain paper sheet nor in a coated paper sheet.

As a result, as shown in FIG. 10, with the structure according to the comparative example (FIG. 7), a crease occurred when either of simplex printing and duplex printing was performed on a low-basis-weight plain paper sheet and on a coated paper sheet.

In contrast, with the structure according to the present exemplary embodiment (FIG. 4), when duplex printing was performed, a crease occurred in a coated paper sheet but did not occur in a low-basis-weight plain paper sheet; and, when simplex printing was performed, a crease did not occur in a low-basis-weight plain paper sheet nor in a coated paper sheet.

With the structure according to the modification (FIG. 9), either when simplex printing was performed or when duplex printing was performed, a crease did not occur in a low-basis-weight plain paper sheet nor in a coated paper sheet.

As described above, in the evaluation, it was confirmed that occurrence of a crease in a recording medium P was suppressed with the structure according to the present exemplary embodiment (FIG. 4) and with the structure according to the modification (FIG. 9).

In the present exemplary embodiment, the middle portion of the decurling shaft 80 in the axial direction is controlled to become convexly curved downstream in the transport direction by using the upstream roller 91 and the downstream rollers 92 and 94. However, this is not a limitation. For example, the decurling shaft 80 may be controlled to become convexly curved by using a member that is not a roller. As each of the first and second contact members, for example, a member that slidably contacts the decurling shaft 80 without rotating (such as a pad) may be used.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A decurling device comprising:

a shaft;

a decurling roller that has a diameter larger than that of the shaft, that becomes concave along an outer periphery of the shaft by being pressed against the shaft, and that removes curl from a transported object by nipping the transported object between the decurling roller and the shaft; and a restriction unit that restricts a direction in which the shaft is bent due to a load that the shaft receives from the decurling roller so that a middle portion of the shaft in an axial direction is convexly curved downstream in a transport direction of the transported object, wherein the restriction unit includes a pair of first contact members that are disposed on an opposite side of the shaft from the decurling roller, the first contact members being in contact with the shaft at positions that are near both ends of the shaft in the axial direction and that are downstream in the transport direction from a straight line that connects an axis of the shaft and a roller axis of the decurling roller to each other, and a second contact member that is disposed on the opposite side of the shaft from the decurling roller and that restricts bending of the middle portion, in the axial direction, of the shaft upstream in the transport direction by contacting the middle portion at a position that is upstream from the straight line in the transport direction, a distance from the position at which the second contact member is in contact with the shaft to the straight line being larger than a distance from the positions at which the first contact members are in contact with the shaft to the straight line.

2. The decurling device according to claim 1, wherein the first contact members are first contact rollers, and wherein the second contact member is a second contact roller, and a distance from the straight line to a roller axis of the second contact roller is larger than a distance from the straight line to roller axes of the first contact rollers.

3. The decurling device according to claim 2, wherein the roller axis of the second contact roller is nearer to the decurling roller than the roller axes of the first contact roller are.

4. The decurling device according to claim 2, wherein the first contact rollers and the second contact roller each include an elastic layer in an outer peripheral portion thereof, and wherein the elastic layers of the first contact rollers are each thicker than the elastic layer of the second contact roller.

5. The decurling device according to claim 3, wherein the first contact rollers and the second contact roller each include an elastic layer in an outer peripheral portion thereof, and wherein the elastic layers of the first contact rollers are each thicker than the elastic layer of the second contact roller.

6. An image forming apparatus comprising:

an image forming unit that forms an image on a recording medium;

a fixing unit that fixes the image to the recording medium; and the decurling device according to claim 1 for removing curl from the recording medium to which the image has been fixed.

* * * * *